US010667356B2

(12) United States Patent
Li et al.

(10) Patent No.: US 10,667,356 B2
(45) **Date of Patent: *May 26, 2020**

(54) DIMMING CONTROLLERS AND DIMMING METHODS CAPABLE OF RECEIVING PWM DIMMING SIGNAL AND DC DIMMING SIGNAL

(71) Applicant: Leadtrend Technology Corporation, Zhubei, Hsinchu County (TW)

(72) Inventors: Chun Hsin Li, Zhubei (TW); Wei Cheng Su, Zhubei (TW); Ruei Jhih Jheng, Zhubei (TW)

(73) Assignee: LEADTREND TECHNOLOGY CORPORATION, Zhubei, Hsinchu County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/507,778

(22) Filed: Jul. 10, 2019

(65) Prior Publication Data

US 2019/0335556 A1 Oct. 31, 2019

Related U.S. Application Data

(63) Continuation-in-part of application No. 16/199,367, filed on Nov. 26, 2018, now Pat. No. 10,397,997.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 45/10*** | (2020.01) |
| ***H05B 45/37*** | (2020.01) |

(52) U.S. Cl.
CPC ..... *H05B 45/10* (2020.01); *H05B 45/37* (2020.01)

(58) Field of Classification Search
None
See application file for complete search history.

(56) References Cited

U.S. PATENT DOCUMENTS

| | | | | |
|---|---|---|---|---|
| 10,397,997 | B2 * | 8/2019 | Li | H05B 33/0845 |
| 2011/0187283 | A1 | 8/2011 | Wang et al. | |
| 2015/0359057 | A1 | 12/2015 | Lee | |
| 2016/0255693 | A1 | 9/2016 | Wang et al. | |

* cited by examiner

*Primary Examiner* — Anh Q Tran
(74) *Attorney, Agent, or Firm* — McClure, Qualey & Rodack, LLP

(57) ABSTRACT

A dimming controller is capable of receiving a dimming signal to dim light-emitting device no matter the dimming signal is of DC or of PWM. A type identifier identifies whether the dimming signal received from an input node is of DC or of PWM. A multiplexer with an output is controlled by the type identifier and configured to provide at least a DC signal path and a PWM signal path both coupled between the input node and the output. The type identifier makes the multiplexer enable the DC signal path and interrupt the PWM signal path if the dimming signal is identified as of DC, and makes the multiplexer enable the PWM signal path and interrupt the DC signal path if the dimming signal is identified as of PWM.

15 Claims, 8 Drawing Sheets

DIMMING CONTROLLERS AND DIMMING METHODS CAPABLE OF RECEIVING PWM DIMMING SIGNAL AND DC DIMMING SIGNAL

CROSS-REFERENCE TO RELATED APPLICATION

This application claims priority to and the benefit of Taiwan Application Series Number 108115378 filed on May 3, 2019, which is incorporated by reference in its entirety. This application also is a continuation-in-part application of U.S. application Ser. No. 16/199367 filed on Nov. 26, 2018, which is now allowable.

BACKGROUND

The present disclosure relates generally to dimming controllers and dimming methods, and, more particularly, to dimming controllers suitable of receiving a dimming signal no matter it is a pulse-width-modulation (PWM) signal or a direct-current (DC) signal.

Light emitting diode (LED), due to its characteristics in high power efficiency, compact product size, and long lifespan, has been widely adapted by lighting appliances and backlight modules. Until recently, most of cold cathode fluorescent lamps (CCFL) in the backlight modules of TV or computer display panels, for example, are replaced by LED modules.

LED modules usually need dimming controllers to perform light dimming, so as to adjust the luminance of a display panel for example. There are two different methods in the art to dim the luminance of a LED module: PWM dimming and DC dimming. PWM dimming, also named digital dimming, employs a PWM or digital signal that jumps quickly back-and-forth between levels of "0" and "1" in logic to determine the duty cycle of a LED module, the ratio of the time when the LED module emits light to the cycle time of the PWM signal. For example, when the PWM signal is "1" in logic, the luminance of the LED module is in its maximum, and when the PWM signal is "0", it is zero, not emitting light. In other words, PWM dimming makes a LED module blinking. In contrast, DC dimming, also known as analog dimming or resistive dimming, makes a LED module emitting light continuously while the luminance of the LED module corresponds to the voltage level of a DC or analog signal.

For having more market share, a dimming controller should accommodate a dimming signal no matter the dimming signal is of PWM or of DC, and provide appropriate luminance control.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified. These drawings are not necessarily drawn to scale. Likewise, the relative sizes of elements illustrated by the drawings may differ from the relative sizes depicted.

The invention can be more fully understood by the subsequent detailed description and examples with references made to the accompanying drawings, wherein.

DETAILED DESCRIPTION

Figure 1:
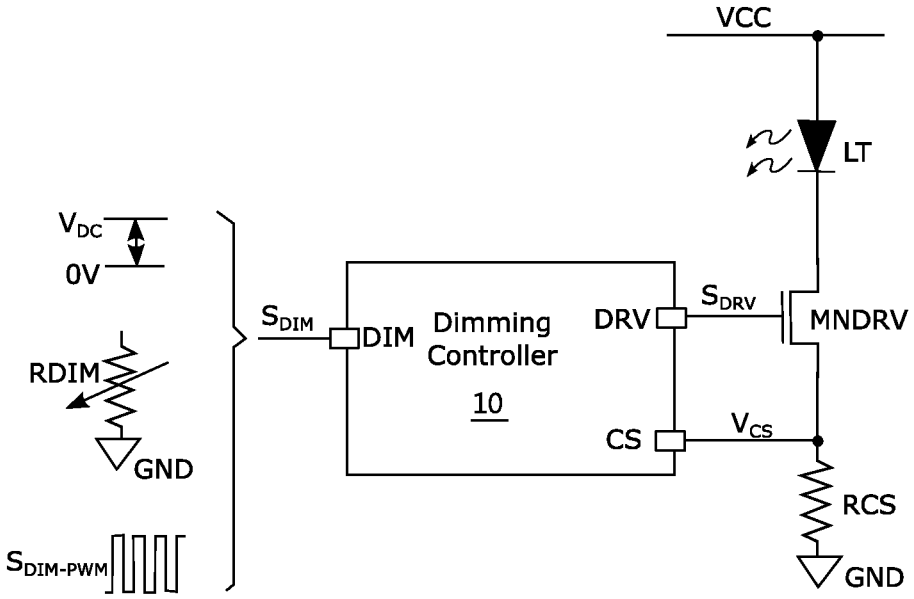
FIG. 1 illustrates dimming controller 10 that controls the luminance of light-emitting device LT via power transistor MNDRV.

According to embodiments of the invention, FIG. 1 illustrates dimming controller 10 that controls the luminance of light-emitting device LT via power transistor MNDRV.

Power transistor MNDRV could be a NMOS transistor, acting as a current driver providing current with a proper magnitude to light-emitting device LT. Light-emitting device LT could be one or plurals of light-emitting diodes connected in series or in parallel. Dimming controller 10 provides driving signal $S_{DRV}$ to the control gate of power transistor MNDRV. The current flowing through light-emitting device LT is monitored by dimming controller 10, as it is sensed by current-sense resistor RCS to provide current-sense signal $V_{CS}$ at current-sense node CS. Dimming controller 10 receives dimming signal $S_{DIM}$ from input node DIM to provide driving signal $S_{DRV}$ accordingly.

As shown in FIG. 1, the configuration of dimming controller 10 enables three different kinds of external connection to perform dimming control. For the first one, external circuit (not shown) generates and provides DC voltage $V_{DC}$ used as dimming signal $S_{DIM}$ to input node DIM, and the voltage level of DC voltage $V_{DC}$ represents the luminance of light-emitting device LT. For the second one, variable resistor RDIM connects between input node DIM and ground voltage GND, and the resistance of variable resistor RDIM is converted by dimming controller 10 into DC voltage $V_{DC}$ representing the luminance of light-emitting device LT. How the resistance of variable resistor RDIM is converted into DC voltage $V_{DC}$ at input node DIM will be detailed later on. For the third one, external circuit generates and provides PWM signal $S_{DIM\text{-}PIM}$ used as dimming signal $S_{DIM}$ to input node DIM, and the duty cycle of PWM signal $S_{DIM\text{-}PWM}$ represents the luminance of light-emitting device LT.

In other words, dimming signal $S_{DIM}$ could be of DC or of PWM. Dimming signal $S_{DIM}$ could be categorized into one of two types: DC and PWM.

Figure 2:
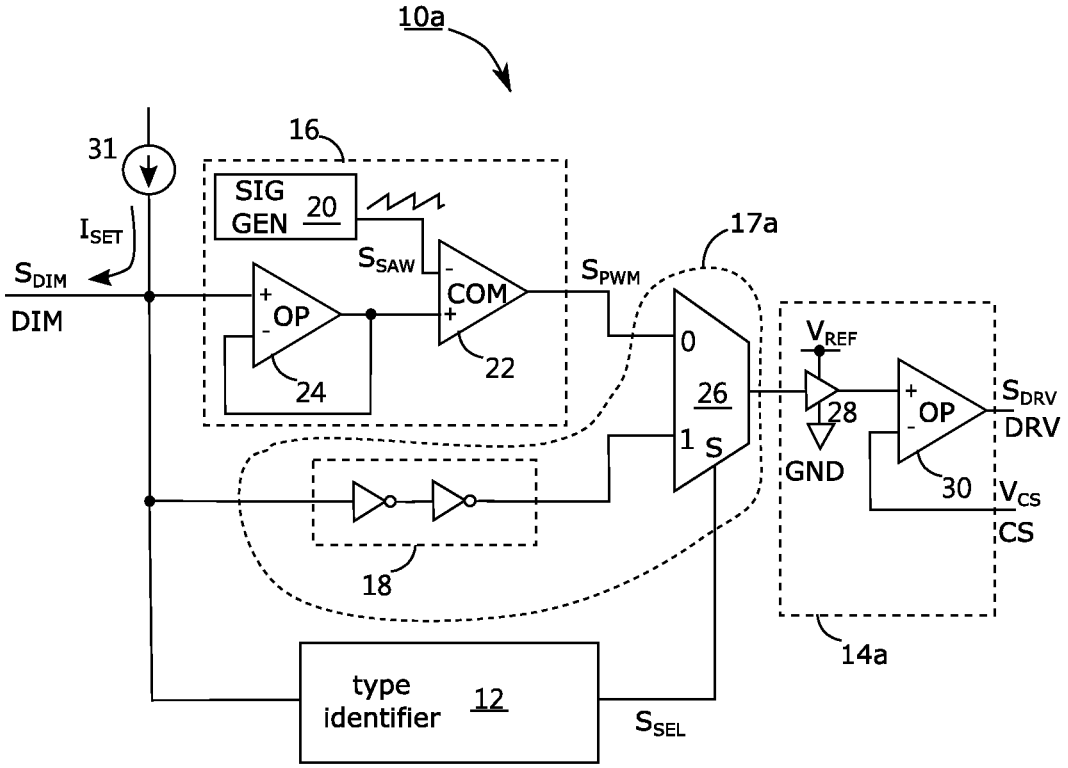
FIG. 2 demonstrates dimming controller 10*a;*

FIG. 2 demonstrates dimming controller 10*a,* which could be dimming controller 10 in FIG. 1 according to embodiments of the invention. Dimming controller 10*a* has type identifier 12, DC-to-PWM converter 16, multiplexer 17*a,* LED driver 14*a,* and constant current source 31.

Figure 3:
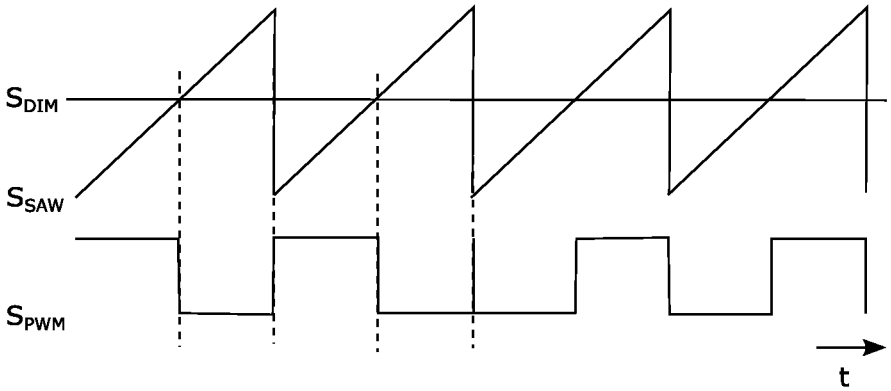
FIG. 3 shows the correlation between dimming signal $S_{DIM}$, saw-wave signal $S_{SAW}$ and PWM signal $S_{PWM}$.

DC-to-PWM converter 16 is a signal converter and, if dimming signal $S_{DIM}$ is identified as of DC, DC-to-PWM converter 16 converts dimming signal $S_{DIM}$ into PWM signal $S_{PWM}$. Shown in FIG. 2, DC-to-PWM converter 16 has signal generator 20, operational amplifier 24 and comparator 22. Please refer to FIG. 3, showing the correlation between dimming signal $S_{DIM}$, saw-wave signal $S_{SAW}$ and PWM signal $S_{PWM}$. Configured as a unity-gain buffer, operational amplifier 24 reproduces the voltage level of dimming signal $S_{DIM}$ at the non-inverting input of comparator 22. Signal generator 20 provides the inverting input of comparator 22 saw-wave signal $S_{SAW}$, which, like a clock, is periodically reset to its original starting voltage. Comparator 22 compares saw-wave signal $S_{SAW}$ with dimming signal $S_{DIM}$ to generate PWM signal $S_{PWM}$. As shown in FIG. 3, PWM signal $S_{PWM}$ is "0" in logic when saw-wave signal $S_{SAW}$ exceeds dimming signal $S_{DIM}$, and "1" in logic when saw-wave signal $S_{SAW}$ is lower than dimming signal $S_{DIM}$.

Type identifier 12 is connected to input node DIM, for identifying whether dimming signal $S_{DIM}$ at input node DIM is of DC or of PWM, and accordingly provides selection signal $S_{SEL}$ to control multiplexer 17*a*. Type identifier 12 in FIG. 2 makes selection $S_{DIM}$ "1" in logic if it identifies dimming signal $S_{DIM}$ as of PWM, and "0" in logic if it identifies dimming signal $S_{DIM}$ as of DC.

Figure 4:
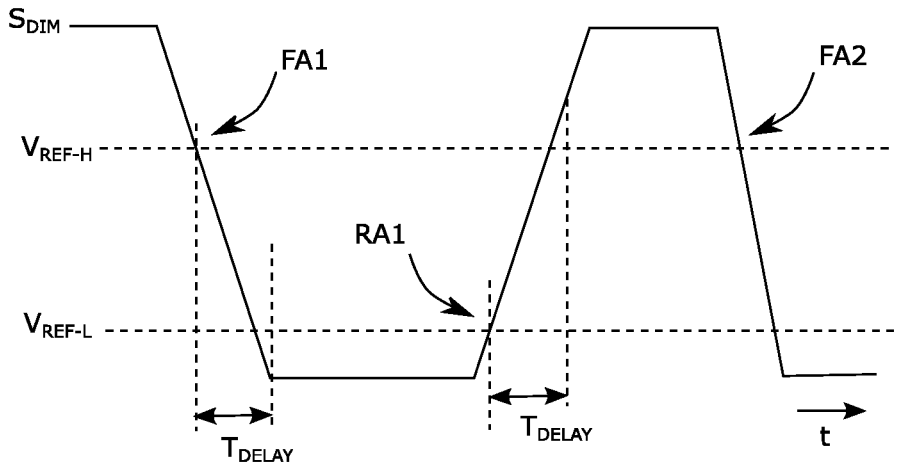
FIG. 4 exemplifies the waveform of dimming signal $S_{DIM}$.

According to embodiments of the invention, selection signal $S_{SEL}$ is determined in response to edges of dimming signal $S_{DIM}$. FIG. 4 exemplifies the waveform of dimming signal $S_{DIM}$ that has two falling edges FA1 and FA2, and a rising edge RA1. Type identifier 12 provides selection signal $S_{SEL}$ based on whether there are an enough number of significant edges within a predetermined period of time. An edge is significant to be an edge of a PWM signal when its tilt is large enough. For example, if there are more than 4 rising or falling edges found within a window of 8 ms and each of these edges has a slope whose absolute value exceeds 0.1V/us, type identifier 12 identifies dimming signal $S_{DIM}$ as of PWM, making selection signal $S_{SEL}$ "1" in logic. Two criteria must be satisfied to make selection signal $S_{SEL}$ "1" in logic, for example. The first one is the count of rising or falling edges in a window of 8 ms must be larger than 4. The second one is each of these edges has a slope whose absolute value exceeds 0.1V/us. In the opposite, once type identifier 12 cannot find 4 edges, each having a tilt large enough, within a window of 8 ms for example, it identifies dimming signal $S_{DIM}$ as of DC, making selection signal $S_{SEL}$ "0" in logic.

Taking the waveform in FIG. 4 for example, type identifier 12, according to an embodiment of the invention, deems falling edge FA1 starting when dimming signal $S_{DIM}$ goes down below reference voltage $V_{REF-H}$ and starts a window of delay time $T_{DELAY}$. At the end of delay time $T_{DELAY}$, type identifier 12 compares dimming signal $S_{DIM}$ with reference voltage $V_{REF-L}$, so as to know whether the absolute slope value of falling edge FA1 exceeds $(V_{REF-H}-V_{REF-L})/T_{DELAY}$ or not. Analogously, type identifier 12 deems rising edge RA1 starting when dimming signal $S_{DIM}$ goes up over reference voltage $V_{REF-L}$ and starts another window of delay time $T_{DELAY}$. At the end of delay time $T_{DELAY}$, type identifier 12 compares dimming signal $S_{DIM}$ with reference voltage $V_{REF-H}$, so as to know whether the absolute slope value of rising edge RA1 exceeds $(V_{REF-H}-V_{REF-L})/T_{DELAY}$. In another embodiment of the invention, type identifier 12 checks whether or not the falling time for dimming signal $S_{DIM}$ going down from reference voltage $V_{REF-H}$ to reference voltage $V_{REF-L}$ is longer than delay time $T_{DELAY}$, so as to know whether a falling edge is significant enough to be a falling edge of a PWM signal. The rising time for dimming signal $S_{DIM}$ rising from reference voltage $V_{REF-L}$ to reference voltage $V_{REF-H}$ is also compared with delay time $T_{DELAY}$ to know whether a rising edge could be deemed as a rising edge of a PWM signal. If there are an enough number of edges each having an absolute slope value larger than $(V_{REF-H}-V_{REF-L})/T_{DELAY}$, then dimming signal $S_{DIM}$ looks like a PWM signal, and selection signal $S_{SEL}$ becomes "1". Otherwise, dimming signal $S_{DIM}$ should be a DC signal, and selection signal $S_{SEL}$ becomes "0".

Multiplexer 17*a* in FIG. 2 has digital buffer 18 and multi-input, single-output switch 26. Digital buffer 18 is a signal buffer that reproduces and provides dimming signal $S_{DIM}$ to multi-input, single-output switch 26 if dimming signal $S_{DIM}$ is identified as of PWM. Controlled by type identifier 12, multiplexer 17*a* has two inputs receiving PWM signal $S_{PWM}$ and dimming signal $S_{DIM}$ respectively. When type identifier 12 identifies dimming signal $S_{DIM}$ as of DC, multiplexer 17*a* is controlled to select PWM signal $S_{PWM}$ and forward it to LED driver 14*a*, while isolating dimming signal $S_{DIM}$ from LED driver 14*a*. When type identifier 12 identifies dimming signal $S_{DIM}$ as of PWM, multiplexer 17*a* isolates PWM signal $S_{PWM}$ from LED driver 14*a*, and digital buffer 18 passes dimming signal $S_{DIM}$ on to multi-input, single-output switch 26, which, as controlled by selection signal $S_{SEL}$, forwards dimming signal $S_{DIM}$ to LED driver 14*a*. What multiplexer 17*a* outputs to LED driver 14*a* is always a PWM signal, which is either dimming signal $S_{DIM}$ or PWM signal $S_{PWM}$, where PWM signal $S_{PWM}$ represents dimming signal $S_{DIM}$ when dimming signal $S_{DIM}$ is of DC.

Selection signal $S_{SEL}$ shown in FIG. 2 controls multiplexer 17*a* only, but the invention is not limited to however. According to embodiments of the invention, when dimming signal $S_{DIM}$ is identified as of PWM, DC-to-PWM conversion is unnecessary, so type identifier 12 sends selection signal $S_{SEL}$ to disenable or shut down DC-to-PWM converter 16, saving electric power. In the opposite, if dimming signal $S_{DIM}$ is identified as of DC, digital buffer 18 is optionally shut down or disenabled to save electric power.

LED driver 14*a* receives a PWM signal only, and controls power transistor MNDRV to regulate current flowing through light-emitting device LT in response to what multiple-input, single-output switch 26 outputs. If the output of multiple-input, single-output switch 26 is "1" in logic, level shifter 28 outputs reference voltage $V_{REF}$, and operational amplifier 30 makes the current through light-emitting device LT about $V_{REF}/R_{CS}$, where $R_{CS}$ is the resistance of current-sense resistor RCS. If the output of multiple-input, single-output switch 26 is "0" in logic, level shifter 28 outputs 0 V, and operational amplifier 30 makes the current through light-emitting device LT about 0.

Constant current source 31 provides constant current $I_{SET}$, which, if there is variable resistor RDIM connected between input node DIM and ground voltage GND, goes through variable resistor RDIM to generate at input node DIM DC voltage $V_{DC}$ used as dimming signal $S_{DIM}$. Accordingly, constant current $I_{SET}$ converts the resistance of variable resistor RDIM into DC voltage $V_{DC}$. While DC voltage $V_{DC}$ or PWM signal $S_{DIM-PWM}$ is directly supplied or defined from an external circuit with low output impedance, constant current $I_{SET}$ could not affect DC voltage $V_{DC}$ or PWM signal $S_{DIM-PWM}$ since constant current $I_{SET}$ is very small in magnitude.

Figure 5:
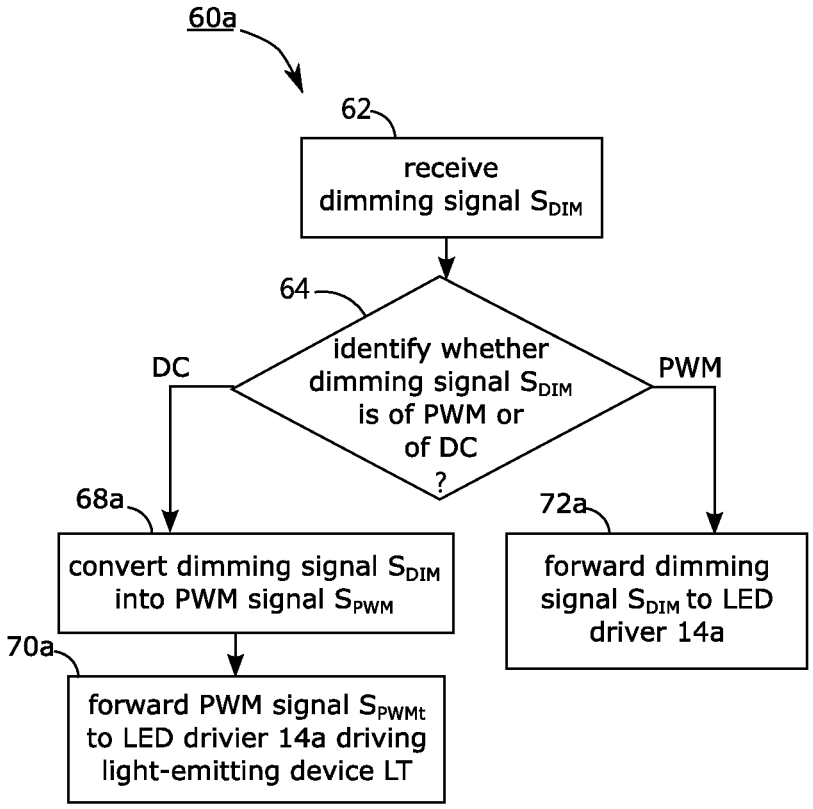
FIG. 5 shows dimming methods 60*a* in use of dimming controller 10*a* in FIG. 2.

FIG. 5 shows dimming method 60*a* in use of dimming controller 10*a* in FIG. 2.

In step 62, dimming controller 10*a* receives at input node DIM dimming signal $S_{DIM}$, which could be a PWM signal or a DC signal.

In step 64 following step 62, type identifier 12 identifies whether dimming signal $S_{DIM}$ is of PWM or of DC, to generate selection signal $S_{SEL}$, which controls multiplexer 17*a*.

Step 68*a* follows step 64 if dimming signal $S_{DIM}$ is identified as of DC. DC-to-PWM converter 16 converts dimming signal $S_{DIM}$ into PWM signal $S_{PWM}$.

Step 70*a*, in response to selection signal $S_{SEL}$ generated in step 64, makes multiplexer 17*a* select PWM signal $S_{PWM}$ and forwards it to LED driver 14*a*, which drives light-emitting device LT accordingly. Meanwhile, the signal path for dimming signal $S_{DIM}$ from input node DIM, via digital buffer 18, and to LED driver 14*a* is disconnected. In one embodiment of the invention, step 70*a* disenables or shuts down digital buffer 18.

Step 72*a*, in response to selection signal $S_{SEL}$ that indicates dimming signal $S_{DIM}$ as a PWM signal, makes multiplexer 17*a* select dimming signal $S_{DIM}$ and forward it via digital buffer 18 and multiple-input, single-output switch 26 to LED driver 14*a* driving light-emitting device LT. Meanwhile, multiplexer 17*a* isolates PWM signal $S_{PWM}$ from LED driver 14*a*.

Dimming controller 10*a* in FIG. 2 and dimming method 60*a* in FIG. 5 have advantages as follows. If dimming signal $S_{DIM}$ is of DC, PWM signal $S_{PWM}$ representing dimming signal $S_{DIM}$ is generated for LED driver 14*a* to drive light-emitting device LT. If dimming signal $S_{DIM}$ is of PWM, dimming signal $S_{DIM}$ is forwarded honestly to LED driver 14*a*, which faithfully and quickly responds to turn ON or OFF light-emitting device LT. No matter dimming signal $S_{DIM}$ is a PWM signal or a DC signal, dimming controller 10*a* can always provide a proper PWM signal to LED driver 14*a* to drive light-emitting device LT appropriately.

Figure 6:
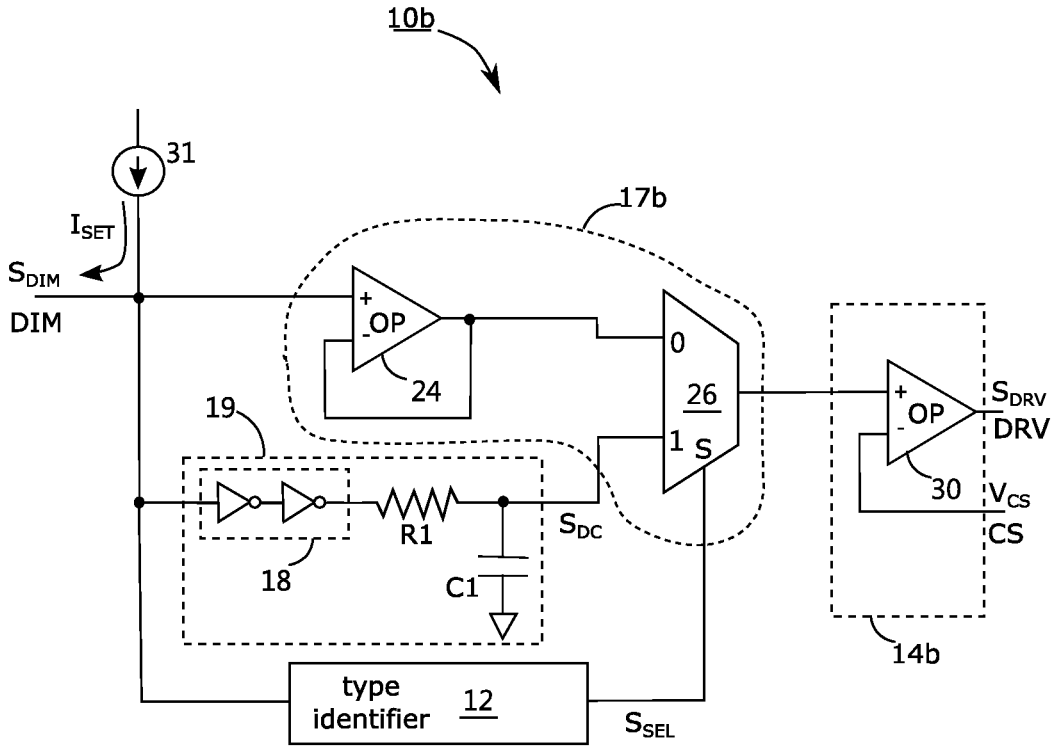
FIG. 6 demonstrates dimming controller 10*b;*

FIG. 6 demonstrates dimming controller 10*b*, which could be dimming controller 10 in FIG. 1 according to embodiments of the invention. Dimming controller 10*b* has type identifier 12, PWM-to-DC converter 19, multiplexer 17*b*, LED driver 14*b*, and constant current source 31. Several devices or circuits in FIG. 6 have been disclosed or taught by FIG. 2 and the relevant paragraphs, and their function and operation are not repeatedly detailed for brevity.

PWM-to-DC converter 19 is a signal converter and, if dimming signal $S_{DIM}$ is of PWM, it is capable of converting dimming signal $S_{DIM}$ into DC signal $S_{DC}$. Shown in FIG. 6, PWM-to-DC converter 19 has digital buffer 18, resistor R1 and capacitor C1. Digital buffer 18 reproduces the logic value of dimming signal $S_{DIM}$ and provides it to resistor R1. Resistor R1 and capacitor C1 together form a low-pass filter, capable of generating DC signal $S_{DC}$ whose voltage level represents the duty cycle of dimming signal $S_{DIM}$.

Multiplexer 17*b* in FIG. 6, controlled by type identifier 12, has two inputs receiving DC signal $S_{DC}$ and dimming signal $S_{DIM}$ respectively. Multiplexer 17*b* has operational amplifier 24 and multiple-input, single-output switch 26. When type identifier 12 identifies dimming signal $S_{DIM}$ as of DC, operational amplifier 24, acting as a unity-gain buffer and a signal buffer, reproduces dimming signal $S_{DIM}$ at its output and forwards dimming signal $S_{DIM}$ to multiple-input, single-output switch 26, which continuously forwards dimming signal $S_{DIM}$ to LED driver 14*b*, but blocks DC signal $S_{DC}$ from reaching LED driver 14*b*. When type identifier 12 identifies dimming signal $S_{DIM}$ as of PWM, multi-input, single-output switch 26 in FIG. 6, as controlled by selection signal $S_{SEL}$, forwards DC signal $S_{DC}$ to LED driver 14*b* and blocks dimming signal $S_{DIM}$ from reaching LED driver 14*b*. What multiplexer 17*b* outputs to LED driver 14*a* is always a DC signal, which is either dimming signal $S_{DIM}$ or DC signal $S_{DC}$, where DC signal $S_{DC}$ represents dimming signal $S_{DIM}$ if dimming signal $S_{DIM}$ is of PWM.

LED driver 14*b* receives a DC signal only, and controls power transistor MNDRV to regulate current flowing through light-emitting device LT in response to what multiple-input, single-output switch 26 outputs. If the output of multiple-input, single-output switch 26 has voltage level $V_{OUT}$, operational amplifier 30 makes the current through light-emitting device LT about $V_{OUT}/R_{CS}$.

Figure 7:
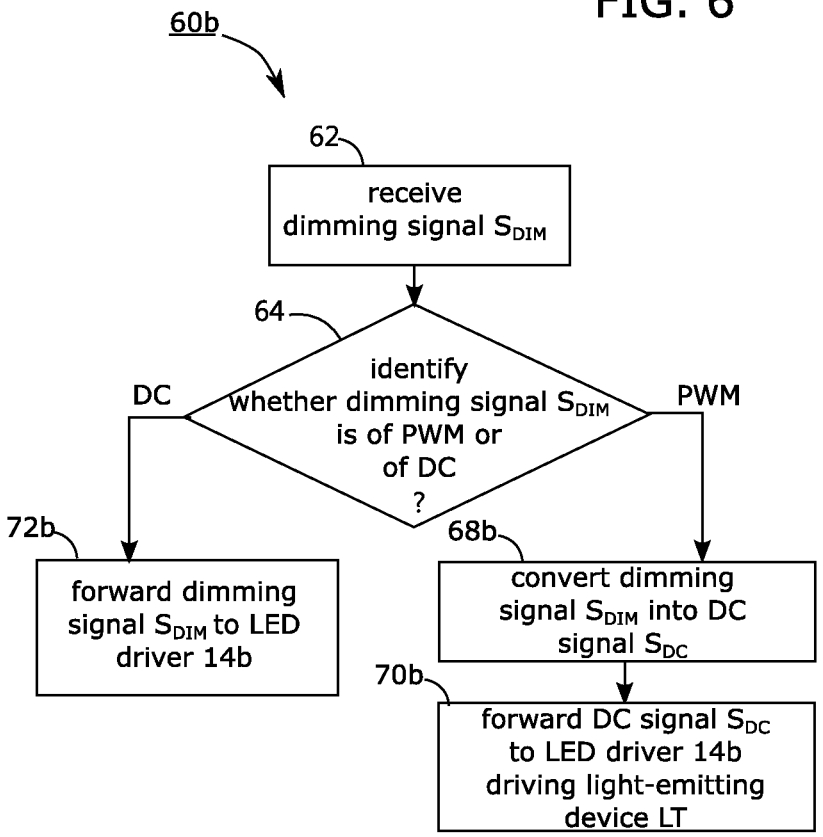
FIG. 7 shows dimming methods 60*b* in use of dimming controller 10*b* in FIG. 6.

FIG. 7 shows dimming method 60*b* in use of dimming controller 10*b* in FIG. 6. Some steps in FIG. 7 are the same or similar with corresponding steps in FIG. 5, so they are not repeatedly detailed here since they are comprehensible in view of related disclosure in the previous paragraphs.

Step 72*b*, in response to selection signal $S_{SEL}$ that indicates dimming signal $S_{DIM}$ is a DC signal, makes multiplexer 17*b* select dimming signal $S_{DIM}$ and forward it via multiple-input, single-output switch 26 to LED driver 14*b* driving light-emitting device LT. Meanwhile, selection signal $S_{SEL}$ causes multiplexer 17*b* to isolate DC signal $S_{DC}$ from LED driver 14*b*.

Step 68*b* follows step 64 if dimming signal $S_{DIM}$ is identified as of PWM. PWM-to-DC converter 19 converts dimming signal $S_{DIM}$ into DC signal $S_{DC}$.

Step 70*b*, in response to selection signal $S_{SEL}$ generated in step 64, follows step 68*b*. Step 70*b* makes multiplexer 17*b* select DC signal $S_{DC}$ and forward it to LED driver 14*b*, which drives light-emitting device LT accordingly. Meanwhile, the signal path for dimming signal $S_{DIM}$ from input node DIM, via operational amplifier 24, and to LED driver 14*b* is interrupted.

Selection signal $S_{SEL}$ shown in FIG. 6 controls multiple-input, single-output switch 26 only, but the invention is not limited to however. According to embodiments of the invention, if dimming signal $S_{DIM}$ is identified as of PWM, operational amplifier 24 is optionally shut down or disenabled to save electric power. Similarly, when dimming signal $S_{DIM}$ is identified as DC, type identifier 12 sends selection signal $S_{SEL}$ to disenable or shut down digital buffer 18, saving electric power.

Dimming controller 10*b* in FIG. 6 and dimming method 60*b* in FIG. 7 have advantages as follows. If dimming signal $S_{DIM}$ is of DC, dimming signal $S_{DIM}$ is forwarded honestly to LED driver 14*b*, which faithfully and analogically adjusts the current through light-emitting device LT. The current through light-emitting device LT is $V_{OUT}/R_{CS}$ if the voltage level of dimming signal $S_{DIM}$ is $V_{OUT}$. While dimming signal $S_{DIM}$ is identified as PWM, DC signal $S_{DC}$, representing the duty cycle of dimming signal $S_{DIM}$, is generated and forwarded to LED driver 14*b* to drive light-emitting device LT. No matter dimming signal $S_{DIM}$ is a PWM signal or a DC signal, dimming controller 10*b* can always provide a proper DC signal to LED driver 14*b* to drive light-emitting device LT appropriately.

This invention is not only useful for driving LEDs however, but could be also applicable for driving other kinds of lighting apparatuses.

Figure 8:
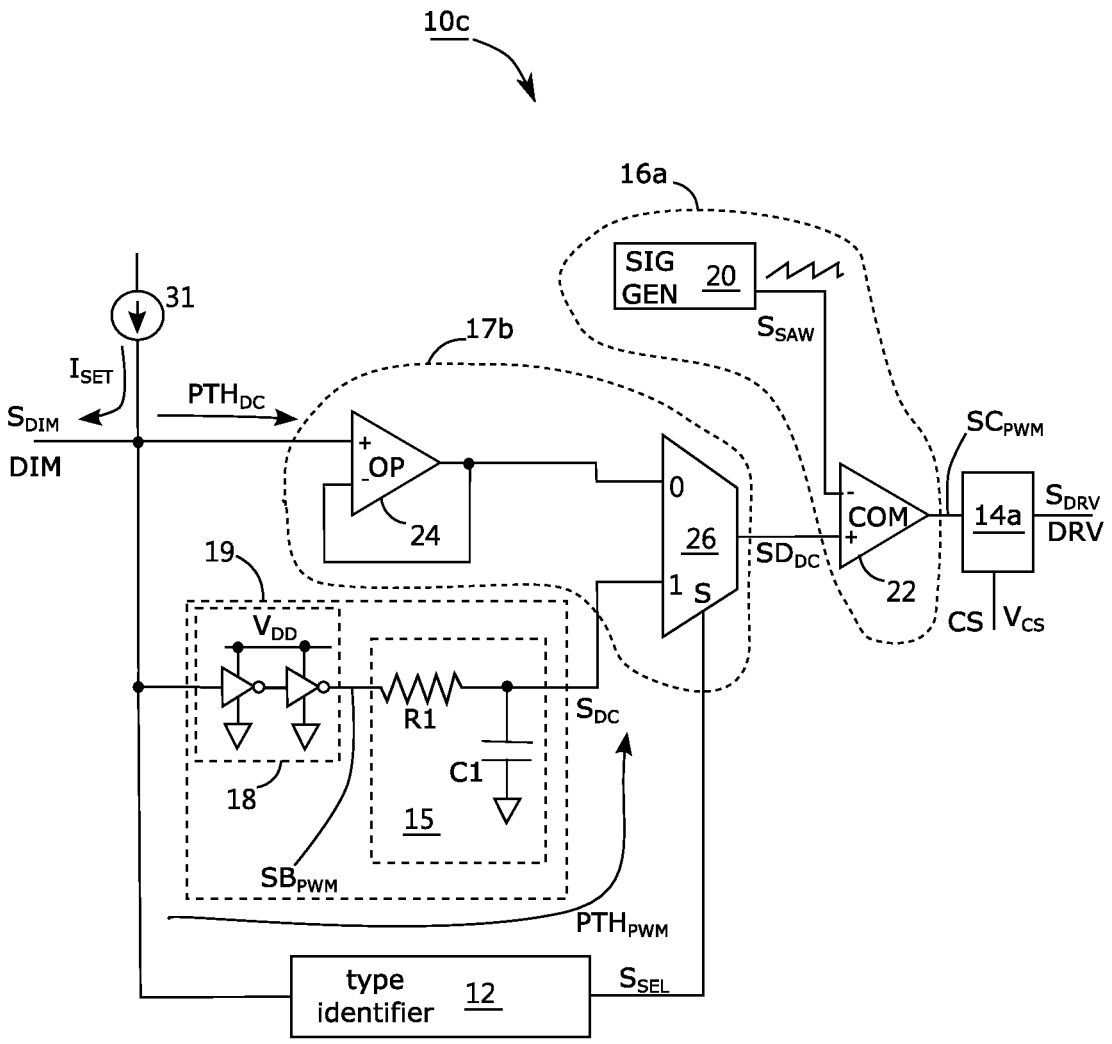
FIG. 8 demonstrates dimming controller 10*c;*

FIG. 8 demonstrates dimming controller 10*c*, which could be dimming controller 10 in FIG. 1 according to embodiments of the invention. Dimming controller 10*c* has type identifier 12, PWM-to-DC converter 19, multiplexer 17*b*, DC-to-PWM converter 16*a*, LED driver 14*a*, and constant current source 31. Several devices or circuits in FIG. 8 have been disclosed or taught by FIG. 2 or 6 and the relevant paragraphs, and their function and operation are not repeatedly detailed for brevity.

PWM-to-DC converter 19 is a signal converter, capable of converting dimming signal $S_{DIM}$, if it is identified as of PWM, into DC signal $S_{DC}$. Shown in FIG. 8, PWM-to-DC converter 19 includes digital buffer 18 and low-pass filter 15. Digital buffer 18 provides at an end of resistor R1 temporary PWM signal $SB_{PWM}$, which reproduces the logic value of dimming signal $S_{DIM}$. Resistor R1 and capacitor C1 together form low-pass filter 15, low-pass filtering temporary PWM signal $SB_{PWM}$ to generate DC signal $S_{DC}$ whose voltage level represents the duty cycle of dimming signal $S_{DIM}$.

The logic value of temporary PWM signal $SB_{PWM}$ always follows that of dimming signal $S_{DIM}$, but temporary PWM signal $SB_{PWM}$ might differ from dimming signal $S_{DIM}$ in logic voltage level. For example, the logic voltage level of "0" in logic for both temporary PWM signal $SB_{PWM}$ and dimming signal $S_{DIM}$ is 0V, but the logic voltage level of "1" in logic for temporary PWM signal $SB_{PWM}$ could be different from that for dimming signal $S_{DIM}$. Dimming signal $S_{DIM}$, which originates from an external circuit, could be 1V, 3V or 5V to represent "1" in logic, meaning the logic voltage level of dimming signal $S_{DIM}$ for "1" in logic is 1V, 3V or 5V. The logic voltage level of temporary PWM signal $SB_{PWM}$ for "1" in logic is predetermined internally by digital buffer 18, and could be a constant, 5V for example. Therefore, digital buffer 18 acts as a level shifter, and makes the logic voltage level of temporary PWM signal $SB_{PWM}$ for logic "1" a predetermined constant regardless of the logic voltage level of dimming signal $S_{DIM}$.

Multiplexer 17*b* in FIG. 8, controlled by type identifier 12, has two inputs receiving DC signal $S_{DC}$ and dimming signal $S_{DIM}$ respectively. Multiplexer 17*b* has operational amplifier 24 and multiple-input, single-output switch 26. When type identifier 12 identifies dimming signal $S_{DIM}$ as of DC, operational amplifier 24, acting as a unity-gain buffer and a signal buffer, reproduces dimming signal $S_{DIM}$ and forwards it to multiple-input, single-output switch 26, which selects the output of operational amplifier 24 as DC signal $SD_{DC}$ and provides it to DC-to-PWM converter 16*a*. Operational amplifier 24 transfers dimming signal $S_{DIM}$ to multiple-input, single-output switch 26 if dimming signal $S_{DIM}$ is of DC. When type identifier 12 identifies dimming signal $S_{DIM}$ as of PWM, multi-input, single-output switch 26 in FIG. 6, as controlled by selection signal $S_{SEL}$, selects DC signal $S_{DC}$ as DC signal $SD_{DC}$ and provides it to DC-to-PWM converter 16*a* while blocking dimming signal $S_{DIM}$ from reaching DC-to-PWM converter 16*a*. What multiplexer 17*b* outputs to DC-to-PWM converter 16*a* is always a DC signal, which is either dimming signal $S_{DIM}$ or DC signal $S_{DC}$, where DC signal $S_{DC}$ represents dimming signal $S_{DIM}$ if dimming signal $S_{DIM}$ is of PWM.

In FIG. 8 exist DC signal path $PTH_{DC}$ and PWM signal path $PTH_{PWM}$, based on which the DC signal $SD_{DC}$ is generated in response to dimming signal $S_{DIM}$ at input node DIM. DC signal path $PTH_{DC}$ goes from input node DIM, through operational amplifier 24 and multi-input, single-output switch 26, and to the non-inverting input of comparator 22. PWM signal path $PTH_{PWM}$ goes from input node DIM, through digital buffer 18, low-pass filter 15 and multi-input, and single-output switch 26, and to the non-inverting input of comparator 22. If type identifier 12 identifies dimming signal $S_{DIM}$ as of DC, type identifier 12 makes multi-input, and single-output switch 26 enable DC signal path $PTH_{DC}$ and interrupt PWM signal path $PTH_{PWM}$. If type identifier 12 identifies dimming signal $S_{DIM}$ as of PWM, type identifier 12 makes multi-input, and single-output switch 26 enable PWM signal path $PTH_{PWM}$ and interrupt DC signal path $PTH_{DC}$.

Apparently, both digital buffer 18 and low-pass filter 15 are located on PWM signal path $PTH_{PWM}$, while operational amplifier 24 is located on DC signal path $PTH_{DC}$.

DC-to-PWM converter 16*a* converts DC signal $SD_{DC}$ into PWM signal $SC_{PWM}$. Shown in FIG. 8, DC-to-PWM converter 16*a* has signal generator 20 and comparator 22. Signal generator 20 provides the inverting input of comparator 22 saw-wave signal $S_{SAW}$, which, like a clock, is periodically reset to its original starting voltage. Comparator 22 compares saw-wave signal $S_{SAW}$ with DC signal $SD_{DC}$ to generate PWM signal $SC_{PWM}$, analogous to what is taught in FIG. 3. The frequency of PWM signal $SC_{PWM}$ is a constant determined by saw-wave signal $S_{SAW}$, and has nothing to do with the frequency of dimming signal $S_{DIM}$ at input node DIM. Furthermore, the logic voltage level of PWM signal $SC_{PWM}$ for logic "1" or "0" could be conveniently customized to fit in the input requirement of LED driver 14*a*.

LED driver 14*a* in FIG. 8 controls power transistor MNDRV in response to PWM signal $SC_{PWM}$, so as to control the current flowing through light-emitting device LT.

Figure 9:
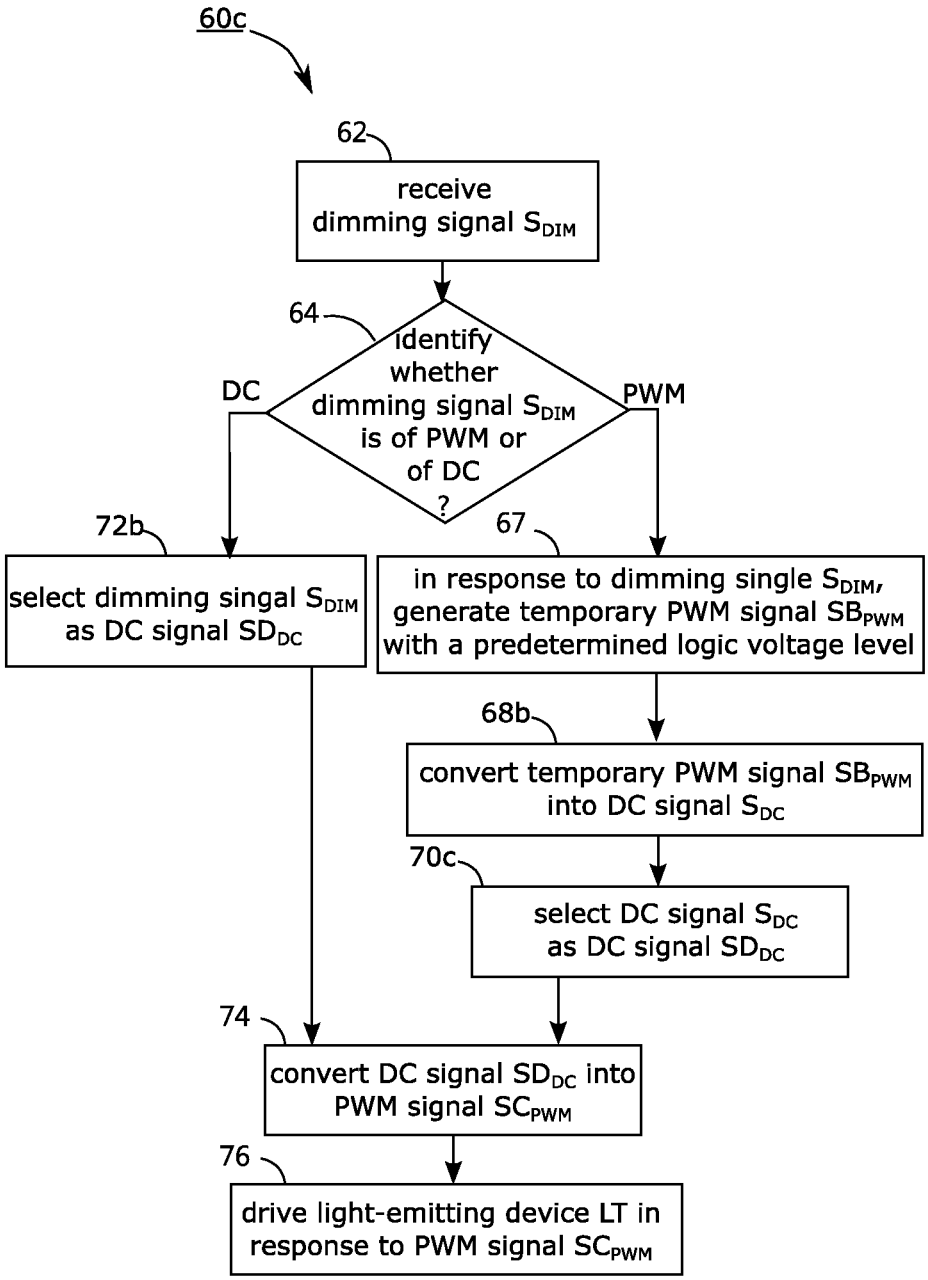
FIG. 9 shows dimming method 60*c* in use of dimming controller 10*c* in FIG. 8.

FIG. 9 shows dimming method 60*c* in use of dimming controller 10*c* in FIG. 8. Some steps of dimming method 60*c* are the same or similar with corresponding steps of dimming methods 60*a* and 60*b*, so they are not repeatedly detailed here since they are comprehensible in view of related disclosure in the previous paragraphs.

Step 72*b*, in response to selection signal $S_{SEL}$ that indicates dimming signal $S_{DIM}$ is a DC signal, makes multiplexer 17*b* enable DC signal path $PTH_{DC}$ to generate DC signal $SD_{DC}$ in response to dimming signal $S_{DIM}$. Step 72*b* also interrupts PWM signal path $PTH_{PWM}$, so multi-input, single-output switch 26 isolates DC signal $SD_{DC}$ from DC signal $S_{DC}$.

Step 67 in FIG. 9 follows when type identifier 21 identifies dimming signal $S_{DIM}$ as of PWM. Digital buffer 18 reproduces the logic value of dimming signal $S_{DIM}$ to provide temporary PWM signal $SB_{PWM}$, which has a predetermined logic voltage level corresponding to a certain logic value.

In FIG. 9, step 68*b* follows step 67 and low-pass filer 15 converts temporary PWM signal $SB_{PWM}$ into DC signal $S_{DC}$.

Step 70*c* of FIG. 9 follows step 68*b*. Step 70*c* makes multiplexer 17*b* select DC signal $S_{DC}$ to be DC signal $SD_{DC}$. In other words, DC signal path $PTH_{DC}$ is enabled to generate DC signal $SD_{DC}$ in response to dimming signal $S_{DIM}$, and PWM signal path $PTH_{PWM}$ is interrupted.

In step 74, DC-to-PWM converter 16*a* converts DC signal $SD_{DC}$ into PWM signal $SC_{PWM}$.

Step 76, performed by LED driver 14*a*, controls power transistor MNDRV to control the current flowing through light-emitting device LT.

Dimming controller 10*c* in FIG. 8 and dimming method 60*c* in FIG. 9 have advantages as follows. Regardless whether dimming signal $S_{DIM}$ is of PWM or of DC, dimming controller 10*c* could always generate corresponding PWM signal $SC_{PWM}$, which has a constant frequency and a predetermined logic voltage level, to dim the light-emitting device LT properly.

Multi-input, single-output switch 26 in dimming controller 10*a*, 10*b* or 10*c* is used to select one of two dimming signals with a common signal type. In dimming controller 10*a*, multi-input, single-output switch 26 selects one of two PWM signals. In dimming controller 10*b* and 10*c*, multi-input, single-output switch 26 selects one of two DC signals. This invention is not limited to, however. Multi-input, single-output switch 26 in other embodiments of the invention could select one of two dimming signals with different signal types.

Figure 10:
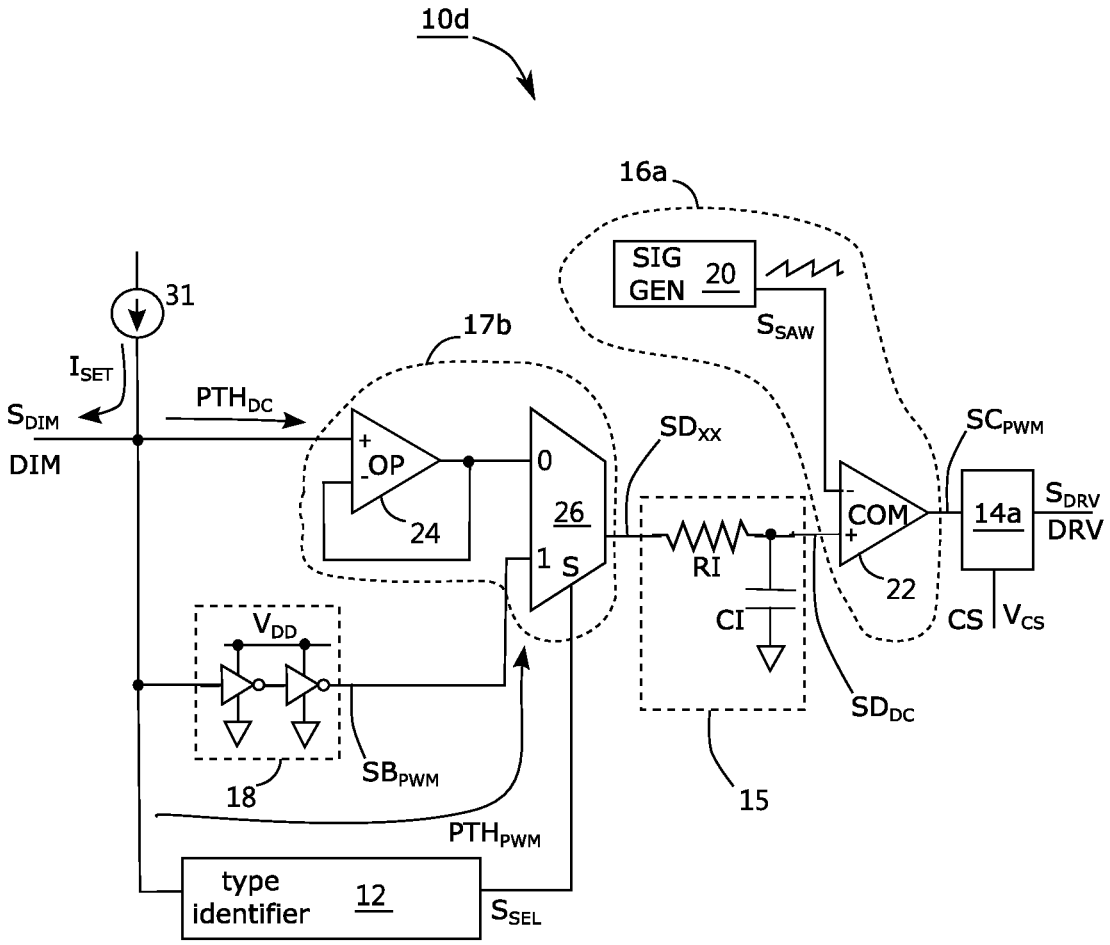
FIG. 10 demonstrates dimming controller 10*d;*.

FIG. 10 demonstrates dimming controller 10*d*, which could be dimming controller 10 in FIG. 1 according to embodiments of the invention. Several devices or circuits in FIG. 10 have been disclosed or taught by dimming controller 10*c* in FIG. 8 and the relevant paragraphs, and their function and operation are not repeatedly detailed for brevity. Dimming controller 10*d* could have the same benefits or advantages with dimming controller 10*c*.

Please note that dimming controller 10*c* in FIG. 8 has low-pass filter 15 connected between multi-input, single-output switch 26 and digital buffer 18. Dimming controller 10*d* in FIG. 10, unlike dimming controller 10*c*, has low-pass filter 15 connected between multi-input, single-output switch 26 and comparator 22. In view of signal transmission, low-pass filter 15 in FIG. 8 provides signals to multi-input, single-output switch 26, while low-pass filter 15 in FIG. 10 receives signals from multi-input, single-output switch 26.

In FIG. 10, multiplexer 17*b*, which includes operational amplifier 24 and multi-input, single-output switch 26, selects one of dimming signal $S_{DIM}$ and temporary signal $SB_{PWM}$, in response to selection signal $S_{SEL}$ output from type identifier 12. The selected one is outputted as output $SD_{XX}$ to low-pass filter 15 which accordingly generate DC signals $SD_{DC}$.

As shown in FIG. 10, when type identifier 12 identifies dimming single $S_{DIM}$ as of DC, multiplexer 17*b* selects DC signal path $PTH_{DC}$ to generate DC signal $S_{DC}$. Multi-input, single-output switch 26 selects the output from operational amplifier 24 to be output $SD_{XX}$, which reproduces dimming single $S_{DIM}$ and is now a DC signal. Meanwhile, even though delays could occur due to signal propagation, low-pass filter 15 has no impact to the voltage level of dimming signal $S_{DIM}$, and can provide DC signal $SD_{DC}$ that faithfully reproduces the voltage level of the dimming signal $S_{DIM}$.

In the other hand, when type identifier 12 in FIG. 10 identifies dimming single $S_{DIM}$ as of PWM, multiplexer 17*b* selects PWM signal path $PTH_{PWM}$ to generate DC signal $SD_{DC}$. Meanwhile, digital buffer 18 acts as a level shifter, and makes the logic voltage level of temporary PWM signal $SB_{PWM}$ for logic "1" a predetermined constant regardless of the logic voltage level of dimming signal $S_{DIM}$. Multi-input, single-output switch 26 now selects temporary PWM signal $SB_{PWM}$ to be output $SD_{XX}$, which is now a PWM signal. Low-pass filter 15 in response low-pass filters output $SD_{XX}$to generate DC signal $SD_{DC}$. In other words, low-pass filter 15 PWM-to-DC converts output $SD_{XX}$ or temporary PWM signal $SB_{PWM}$ into DC signal $SD_{DC}$.

Figure 11:
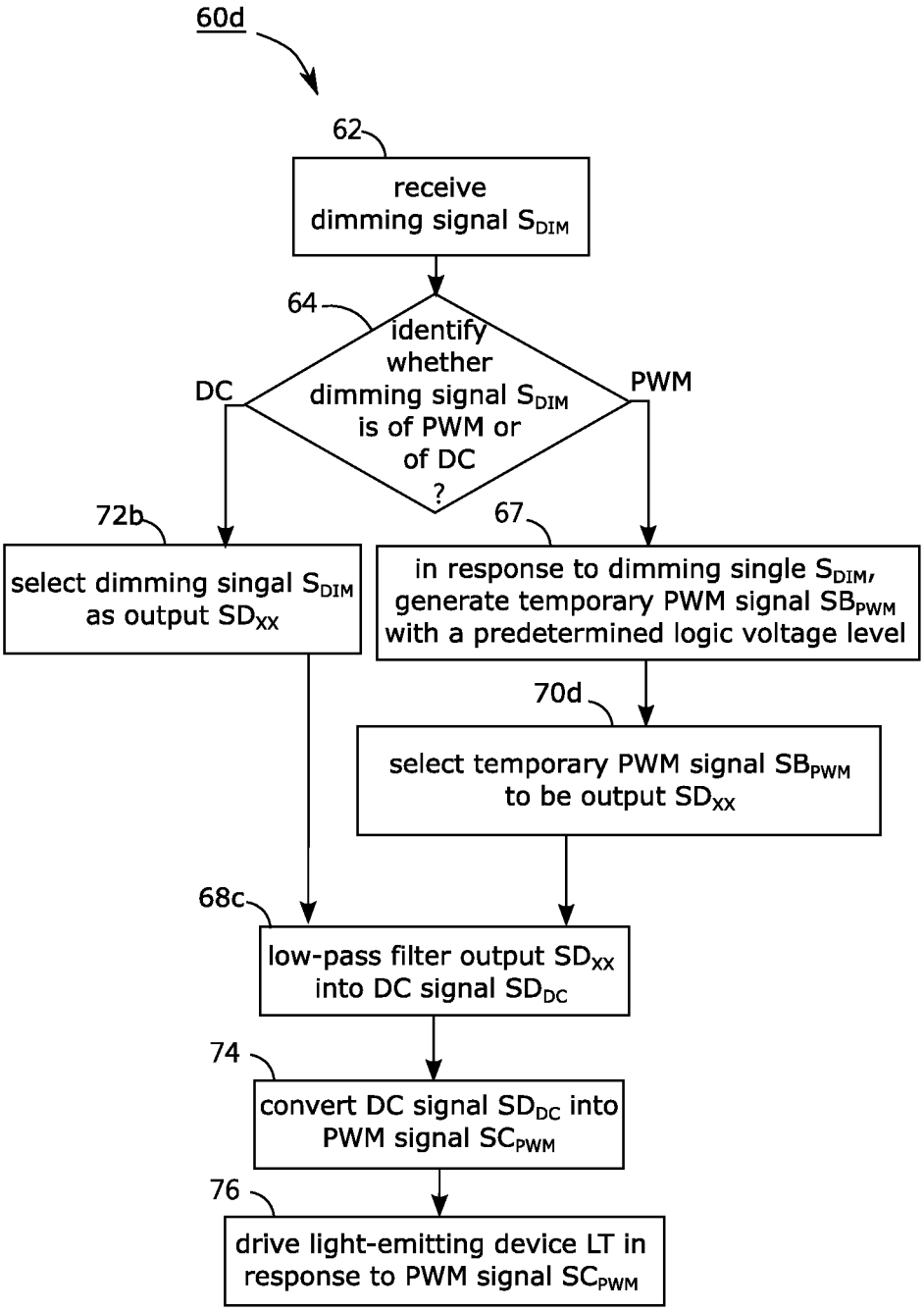
FIG. 11 shows dimming method 60*d* in use of dimming controller 10*d* in FIG. 10.

FIG. 11 shows dimming method 60*d* in use of dimming controller 10*d* in FIG. 10. Some steps of dimming method 60*d* are the same or similar with corresponding steps of dimming method 60*c*, so they are not repeatedly detailed here since they are comprehensible in view of related disclosure in the previous paragraphs.

Dimming method 60*d*, unlike dimming method 60*c*, have step 70*d* following step 67, where step 70 selects temporary PWM signal $SB_{PWM}$ to be output $SD_{XX}$.

Dimming method 60*d* has step 68*c* followings both steps 72*b* and 70*d*. In step 68*c*, low-pass filter 15 low-pass filters output $SD_{XX}$ to generate DC signal $SD_{CS}$.

While the invention has been described by way of example and in terms of preferred embodiment, it is to be understood that the invention is not limited thereto. To the contrary, it is intended to cover various modifications and similar arrangements (as would be apparent to those skilled in the art) . Therefore, the scope of the appended claims should be accorded the broadest interpretation so as to encompass all such modifications and similar arrangements.

What is claimed is:

1. A dimming controller for dimming a light-emitting device, comprising:

an input node for receiving a dimming signal used for dimming the light-emitting device;

a type identifier connected to the input node, for identifying whether the dimming signal is of DC or of PWM; and a multiplexer with an output, the multiplexer controlled by the type identifier and configured to provide at least a DC signal path and a PWM signal path both coupled between the input node and the output;

wherein the type identifier makes the multiplexer enable the DC signal path and interrupt the PWM signal path if the dimming signal is identified as of DC, and makes the multiplexer enable the PWM signal path and interrupt the DC signal path if the dimming signal is identified as of PWM.

2. The dimming controller as claimed in claim 1, further comprising:

a digital buffer located on the PWM signal path, for generating a temporary PWM signal with a predetermined logic voltage level in response the dimming signal.

3. The dimming controller as claimed in claim 2, further comprising:

a PWM-to-DC converter for converting the temporary PWM signal into a DC signal dimming the light-emitting device.

4. The dimming controller as claimed in claim 3, further comprising:

a DC-to-PWM converter for converting the DC signal into a PWM signal dimming the light-emitting device.

5. The dimming controller as claimed in claim 4, wherein the PWM-to-DC converter is coupled between the digital buffer and the multiplexer.

6. The dimming controller as claimed in claim 4, wherein the PWM-to-DC converter is coupled between the multiplexer and the DC-to-PWM converter.

7. The dimming controller as claimed in claim 4, wherein the DC-to-PWM converter comprises:

a signal generator providing a periodical signal; and a comparator comparing the periodical signal with the DC signal to generate the PWM signal.

8. The dimming controller as claimed in claim 3, wherein the PWM-to-DC converter includes a low-pass filter.

9. The dimming controller as claimed in claim 1, wherein the multiplexer comprises a unity-gain buffer located on the DC signal path, the unity-gain buffer transferring the dimming signal when the dimming signal is of DC.

10.

receiving a dimming signal;

identifying whether the dimming signal is either of PWM or of DC;

providing a DC signal path and a PWM signal path;

enabling the DC signal path and interrupting the PWM signal path when the dimming signal is identified as of DC, so as to generate a first signal in response to the dimming signal, wherein the first signal is for dimming the light emitting device; and enabling the PWM signal path and interrupting the DC signal path when the dimming signal is identified as of PWM, so as to generate the first signal in response to the dimming signal.

11. The control method as claimed in claim 10, comprising:

generating a temporary PWM signal in response to the dimming signal when the dimming signal is identified as of PWM, wherein the temporary PWM signal has a predetermined logic voltage level.

12. The control method as claimed in claim 11, comprising:

PWM-to-DC converting the temporary PWM signal into the first signal.

13. The control method as claimed in claim 12, wherein the step of PWM-to-DC converting comprises:

low-pass filtering the temporary PWM signal to generate the first signal.

14. The control method as claimed in claim 12, further comprising:

DC-to-PWM converting the first signal into a PWM signal dimming the light emitting device.

15. The control method as claimed in claim 10, further comprising:

providing a unity-gain buffer located on the DC signal path, the unity-gain buffer generating the first signal when the dimming signal is identified as of DC.

* * * * *